US007008244B2

(12) United States Patent
Alladice

(10) Patent No.: US 7,008,244 B2
(45) Date of Patent: Mar. 7, 2006

(54) EARTHING PIPES

(76) Inventor: Carlton Colin Alladice, 99 Atherstone Road, Measham, Derbyshire (GB) DE12 7EG ( * ) Notice: Subject to any disclaimer, the term of this patent is extended or adjusted under 35 U.S.C. 154(b) by 0 days.

(21) Appl. No.: 10/844,899

(22) Filed: May 12, 2004

(65) Prior Publication Data

US 2005/0255727 A1 Nov. 17, 2005

(51) Int. Cl.
*H01R 13/648* (2006.01)

(52) U.S. Cl. ..... 439/100

(58) Field of Classification Search ..... 439/100, 439/191; 174/78; 248/74.1
See application file for complete search history.

(56) References Cited

U.S. PATENT DOCUMENTS

| | | | | | |
|---|---|---|---|---|---|
| 972,489 | A | * | 10/1910 | Adams | 439/800 |
| 1,505,314 | A | * | 8/1924 | Cox | 439/800 |
| 1,793,911 | A | * | 2/1931 | Dann | 439/777 |
| 1,864,292 | A | * | 6/1932 | Buchanan | 439/777 |
| 2,125,324 | A | * | 8/1938 | Williams et al. | 285/22 |
| 3,058,087 | A | * | 10/1962 | Piasecki | 439/100 |
| 3,286,341 | A | * | 11/1966 | Miller | 228/175 |
| 4,106,832 | A | | 8/1978 | Burns | |
| 4,428,104 | A | * | 1/1984 | Smith | 24/279 |
| 4,626,658 | A | * | 12/1986 | Gray et al. | 219/230 |
| 5,281,761 | A | * | 1/1994 | Woo et al | 174/78 |
| 5,616,036 | A | * | 4/1997 | Polidori | 439/100 |
| 6,641,178 | B1 | * | 11/2003 | Gowing | 285/347 |

FOREIGN PATENT DOCUMENTS

| | | |
|---|---|---|
| FR | 2696 877 A1 | 4/1994 |
| GB | 2 116 378 A | 9/1983 |
| GB | 2 202 693 A | 9/1988 |
| GB | 2 262 194 A | 6/1993 |
| GB | 2 276 282 A | 9/1994 |

* cited by examiner

*Primary Examiner*—Tho D. Ta
(74) *Attorney, Agent, or Firm*—Pedersen & Co., PLLC; Ken J. Pedersen; Barbara S. Pedersen

(57) ABSTRACT

A ground or earth connector comprises a metal tube having an integral connecting member. The earth connector is designed to be attached to a metal pipe, for example, a pipe in a central heating system, with the connecting member being deformable into permanent engagement with an earth cable so as to earth the metal pipe. The earth connector is tubular and is designed to be fitted between two adjacent pipe parts so as also to join the pipe parts together.

15 Claims, 3 Drawing Sheets

EARTHING PIPES

BACKGROUND OF THE INVENTION

1. Field of Invention

The present invention relates to improvements in grounding or "earthing" pipes. In particular, but not exclusively, the invention relates to earthing pipes in a central heating system of a building.

2. Related Art

At present, when installing a combination central heating boiler in a building, all piping to and from the boiler must be grounded or "earth bonded", i.e. connected directly to the ground or earth cable of the electrical system, by law. It is not necessary that the pipes are connected to earth immediately adjacent the boiler, and often the pipes will be grounded or "earth bonded" away from the boiler, for example underneath a sink or wash basin.

The known system of earth bonding the piping is to use an earth bonding clamp. A known earth bonding clamp is of a similar form to the so called Jubilee clip, with an additional screw and washer fastener to grip an electrical cable. Accordingly, the clamp is placed around the pipe and fastened, after which the cable is located between a plate and the washer in the screw fastener portion of the earth clamp. The screw fastener is screwed to increase the tension between the plate and the washer, thereby clamping the cable to the clamp, and hence against the pipe.

The chosen location for the earth bonding clamp is often difficult to access, since the pipework of a building such as a home will necessarily largely be hidden from view. As above described, the earth bonding clamp will often be fitted beneath a sink or wash basin, and the space available to the fitter to manipulate the required tools is limited. In addition, the fitment of the earth bonding clamp is a two-handed job, and the fitter must ensure that the clamp is fitted in a position in which the cable can subsequently be located and held whilst the screw fastener is tightened. Accordingly, the fitment of such an earth bonding clamp is complicated and relatively time-consuming, the whole process taking about two minutes per clamp even for an experienced fitter. In a typical central heating system, six or more pipes go to and from the boiler, so that the time it takes to earth all of the pipes can be about twelve minutes or more.

SUMMARY OF THE INVENTION

An aim of the invention is to provide an improved method of, and product for, grounding a pipe, also known as "earthing" a pipe.

According to a first aspect of the invention there is provided a ground connector or "earth connector" comprising a tube for attachment to a metal pipe, the body having an integral connecting member, the connecting member being designed to be connected to a cable to earth a metal pipe. The connecting member being "integral" means that it is provided as a part of the earth connector and may be attached by solder or other fastening means to the body, or may be formed with the body in a single unit, for example, by molding or other forming techniques.

The tube is preferably made of metal, although a tube not made of metal and defining a conductive path for the cable is envisaged.

The connecting member is preferably blind to the metal body, in that the connecting member preferably is closed by the wall of the metal body to which it is connected.

Preferably, the connecting member is conductive, for example copper, which allows compatibility with the predominant types of pipe in commercial use.

The connecting member is preferably soldered to the metal body.

The connecting member is preferably designed to connect to the cable by a clamping action of one or the other, most preferably the connecting member clamping the cable. Preferably, the connecting member has a cavity, most preferably the cavity is designed to receive an earth cable, most preferably the cavity approximately geometrically matches the cable. Preferably the connecting member is designed to be manually deformed by a hand tool such as pliers to clamp and securely grip an earth cable.

The connecting member may have a recess in an outer wall thereof so as to allow better clamping of a cable. The connecting member may be in the form of a tube, the open end of the tube defining the recess.

The metal tube may be pre soldered, in one form internally of the pipe or member. In a preferred embodiment recesses of the metal body house the solder, most preferably the recesses being one or more annulus.

The metal tube may be designed to fit on a pipe having a diameter of between 6 mm and 200 mm for example, typically of copper type.

The metal tube is open at both ends so as to allow it to be fitted between the ends of two lengths of pipework. The earth connector can therefore provide two functions of connecting two pipe lengths together and allowing the earth connection of the pipe. In the former respect, it is known that plumbers and pipe fitters will often interconnect two pipes close to a sink or wash basin and would previously use a short tubular connector for that purpose, the connector of the present invention fulfils that purpose and also fulfils the latter function also.

According to a second aspect of the invention there is provided a kit of parts for grounding or earthing a metal pipe, the kit comprising a metal tube for attachment to a metal pipe and an earth cable, the metal tube having a connecting member integrally attached to it for connecting the metal tube to the cable, which in turn is connectable to earth.

Preferably, the metal tube has pre-solder thereon or therein.

According to a third aspect of the invention there is provided a (central) heating system having pipes into and out of a boiler, one or more of the pipes having an earth connector in accordance with the first aspect of the invention fitted thereto.

Preferably, all of the pipes have an earth connector in accordance with the first aspect of the invention fitted thereto. Most preferably all of the pipes are earthed.

According to a fourth aspect of the invention there is provided a method of grounding or earthing a metal pipe, comprising the steps of, providing an earth connector in accordance with the first aspect of the invention and connecting an earth cable thereto. Preferably, the metal pipe is part of a central heating system.

Preferably, a cable is inserted into the connecting member. Most preferably, the connecting member is crimped into place over the cable.

DETAILED DESCRIPTION OF THE INVENTION

Figures 1, 2:
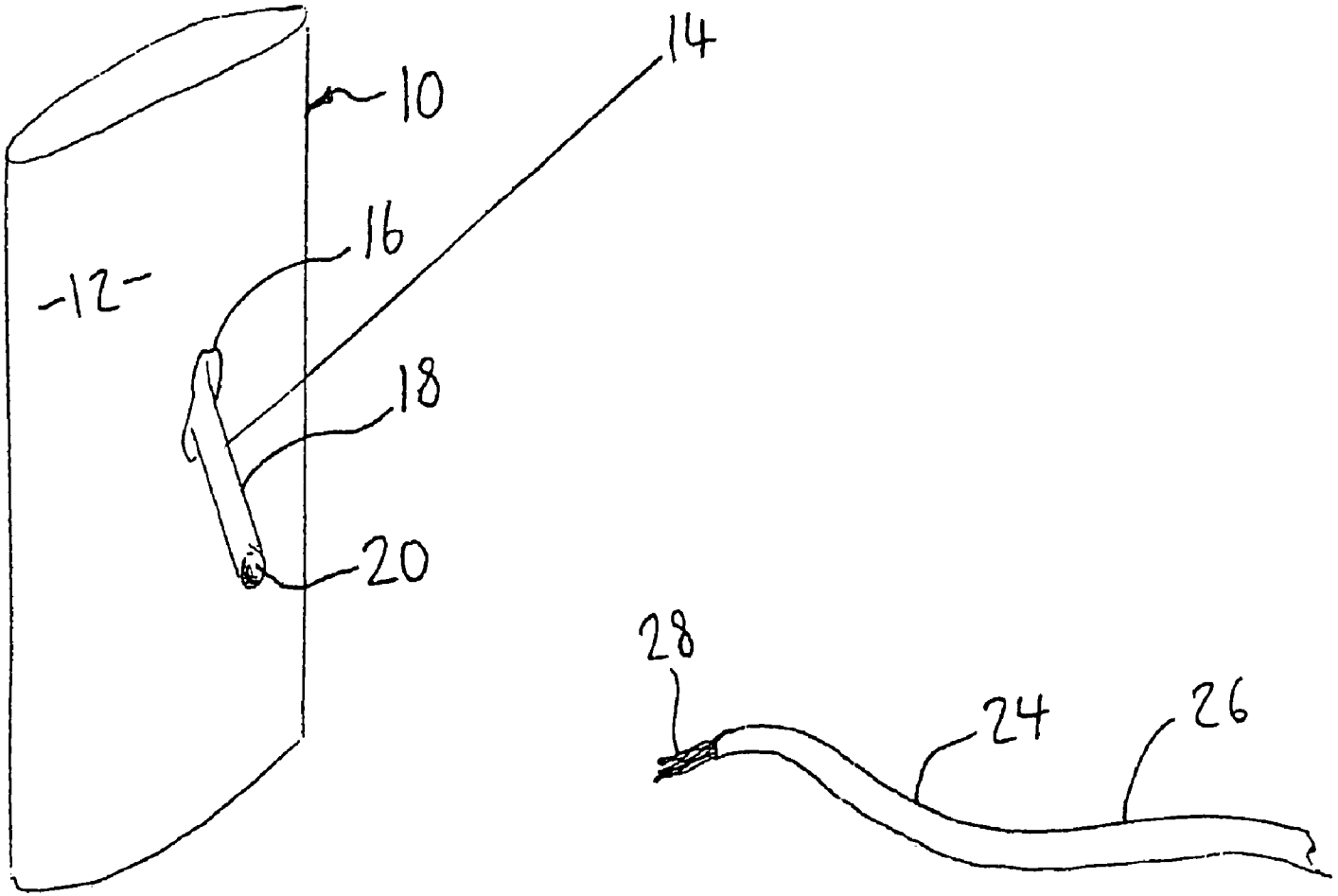
FIG. 1 is a perspective view of an earth connector in accordance with a first embodiment of the invention.
FIG. 2 is a perspective view of a cable for attachment to the earth connector of FIG. 1.

Referring to FIG. 1, the ground or earth connector comprises a tube 10 (in this embodiment of substantially circular cross-section), which has an outer surface 12, on which a connecting member (in the form of a clamp 14) is attached. The clamp 14 is made of copper like the tube 10 but is of much smaller diameter than the tube and has a thinner external wall than the tube for the purpose to be explained below. The clamp 14 is fitted to the tube 10 by a permanent electrically conductive connection, e.g. by way of solder or the like 16. The clamp 14 has an outer wall 18. At one end of the clamp 14, remote from the tube 10, there is a recess 20. Indeed, in the embodiment shown, the clamp 14 is in the form of a tube so in fact this recess 20 continues throughout the clamp 14 to the wall of the tube 10.

Referring to FIG. 2, an earth cable 24 is of conventional form, comprising copper wire(s) and having an insulating sheathing material 26 along most of its length, the insulating material having been removed at the end so as to expose the copper wires 28.

Figure 3:
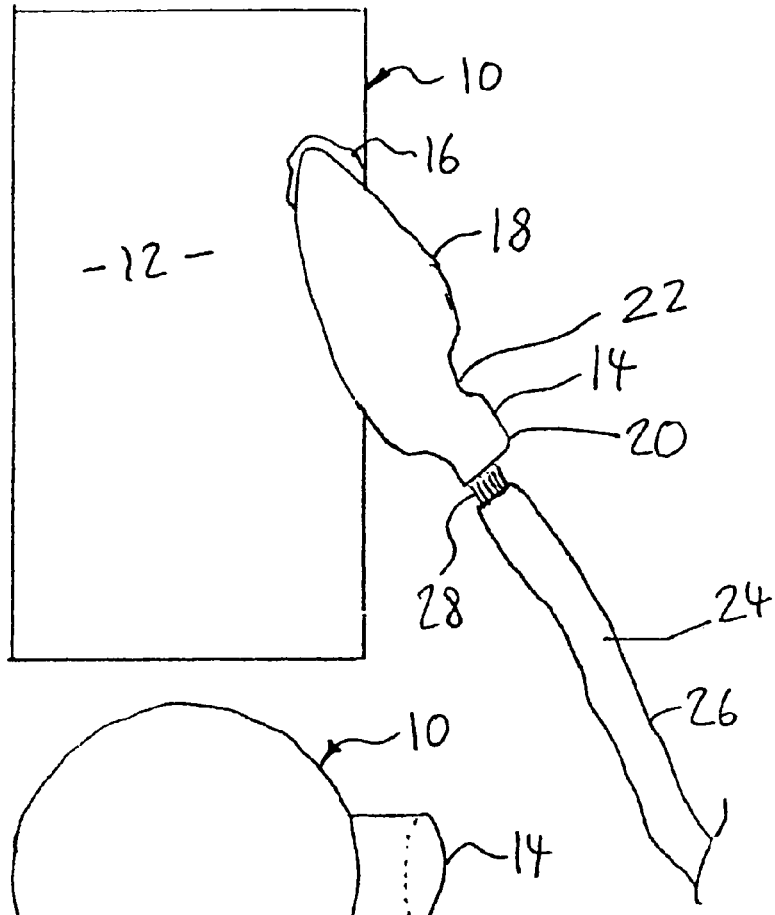
FIG. 3 is a side view of the cable fitted to the earth connector.

Referring to FIG. 3, to form the earth bond the exposed end 28 of the cable 24 is inserted in the cavity 20 of the clamp 14. The clamp 14 is then pressed, e.g. by pliers, (or by another suitable clamping tool, for example a rotating crimper), to clamp the cable 24 in place and provide a permanent electrical connection between the clamp 14 and the cable 24. FIG. 3 shows that the outer wall 18 of the clamp 14 has a recess 22 formed by the clamping tool used to compress the wall 18 into engagement with the wires 28. The clamp 14 can have a preformed deformation or deformations so as to provide a location for the clamping tool if desired, or can be marked to show the optimum position(s) for deforming the clamp, so as to facilitate the clamping operation.

It will be noted from viewing FIG. 3 that in this embodiment the cable 24 is attached to the metal body or tube 10 of the earth connector at an acute angle with respect to the tube longitudinal axis. This allows a greater surface area of the clamp 14 to be in contact with the tube 10 and thereby make the permanent connection between these components more reliable. Also, it is expected that the angled connection to the cable, in particular a downwardly-angled connection in use, will enable easier connection to the earth cable.

Figure 4:
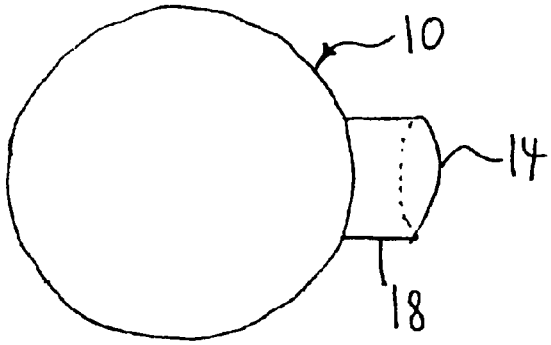
FIG. 4 is a top view of the cable fitted to the earth connector.

It should also be noted, by referring to FIG. 4, that the cable 24 departs substantially radially from the tube 10. This simplifies the construction of the clamp 14, in particular the structure of the clamp where it engages the tube 10. Also, the earth connector is substantially symmetrical about its centre-line (across the page as drawn in FIG. 4), which is expected to allow the earth connector to be equally easy to use with the clamp 14 facing to the left or right, as desired by the fitter. Furthermore, with the restricted access typical of many locations in which the earth connector will be used, a central clamp connection such as that shown is expected to make it easier for the fitter to avoid obstructions both when fitting the tube 10 to the pipework and when subsequently fitting the cable 24 to the clamp 14.

Figure 5:
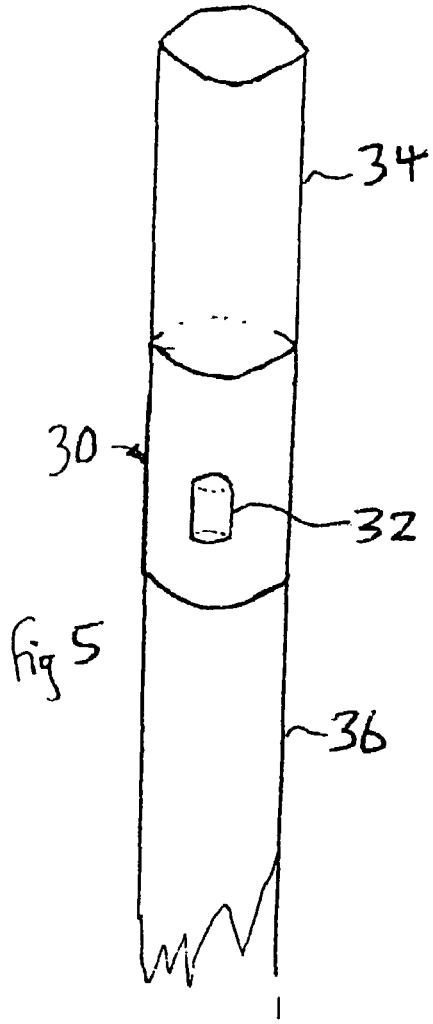
FIG. 5 is a front view of an earth connector fitted on a pipe network.

Referring to FIG. 5, in use the earth connector (which in this embodiment comprises a tube 30 and clamp 32, but could also comprise the tube 10 and the clamp 14), is fitted in line with two pipe parts 34 and 36. The diameter of the pipes, 34 and 36, is about 12½ mm. The pipe parts 34 and 36 are each fed (approximately midway) into the tube 30 and soldered in place. In another embodiment of the invention which is not shown for conciseness, the pipe diameter is about 25 mm. The tube 30 and pipe parts 34 and 36 cooperate to form a continuous pipe, leading to and/or from a boiler. It will be understood that a plumber or pipe fitter will typically connect a number of pipe parts 34, 36 etc. together between the boiler and a tap (for example), and the use of a short connecting piece to interconnect two pipe parts such as 34 and 36 is known. The present invention takes advantage of this fact by allowing replacement of the existing pipe connectors with earth connectors which fulfil the existing requirement and also provide the additional function of earth connection. It is therefore expected that when assembling the pipework from the boiler to a tap (for example) the plumber or pipe fitter will use an earth connector as described herein at the junction between two pipe parts at the chosen location for the earth bond, and will use existing pipe connectors at the other junctions between pipe parts.

FIG. 5 shows a push-fit fitting in which the tube 30 can be pushed over the ends of the pipe parts 34 and 36; as in all other embodiments the tube could, however, be a compression fitting in which the ends of the tube are secured to the respective pipe parts by way of a rotatable nut.

Figure 6:
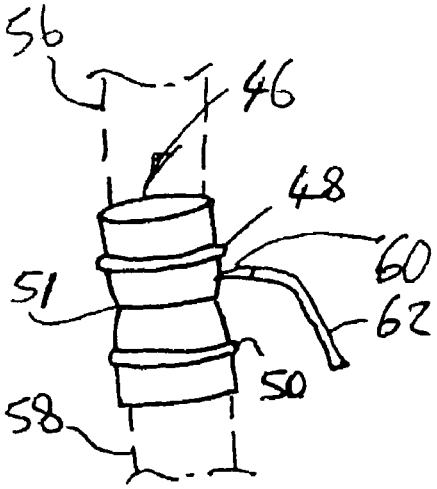
FIG. 6 is a perspective view of an earth connector in accordance with a second embodiment of the invention.
Figure 7:
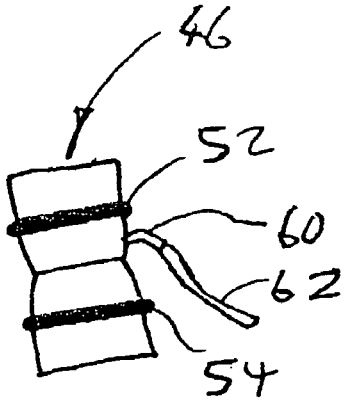
FIG. 7 is a sectional view of the earth connector of FIG. 6 showing internal details.

FIG. 6 shows another embodiment of the invention, in which an earth connector 46, of tubular form, has two annular raised portions 48, 50 and a mid-point 51. FIG. 7, which shows a cut away of the earth connector 46, shows that inside the annular raised portion 48, 50 there is provided a ring of solder material 52, 54. In use, pipe parts 56, 58 (shown in broken line) can be inserted into each end of the earth connector 46 until they engage the mid-point 51. The in situ solder 52, 54, which is of the same internal diameter as the tube 46, can then be heated so as to solder and secure the pipe parts 56, 58 to the connector. Then, the clamp 60 can be connected to an earth cable 62.

It will be understood that in the embodiment of FIG. 6 (as in all embodiments) the connector must make a fluid-tight seal with the pipe parts. Provided that the internal diameter of the tube ends closely match the external diameter of the pipe parts, a soldered connection will achieve the required seal and will also ensure good electrical conductivity between the earth connector and the pipe parts.

It will be appreciated that using the grounding connectors/earth connectors and systems described hereinabove in accordance with the invention, makes forming a ground or earth bond quick and simple in comparison with the prior art method. Specifically, no screw fastening is required, and once the metal body is fitted to the pipework the earth connection can be made quickly and reliably by a simple clamping or crimping operation. Also, in the embodiments having a tubular metal body, fitment of the metal body to the pipework is no more time consuming than fitting an existing pipe connector, the metal body taking the place of the pipe connector.

In the embodiments shown the ground/earth connector, and in particular those with tubular metal bodies, are linear (i.e. the two ends are parallel with each other), but it will be understood that this is not necessarily the case, and the body could comprise a corner or "dog-leg" in which the two ends are perpendicular or otherwise angled relative to one another, if required or desired.

Although this invention has been described above with reference to particular means, materials and embodiments, it is to be understood that the invention is not limited to these disclosed particulars, but extends instead to all equivalents within the scope of the following claims.

What is claimed is:

1. An earth connector comprising a tube for connecting one end of a first pipe part to one end of a second pipe part, the pipe parts when connected being in fluid communication by way of the tube, the tube having a connecting member attached thereto by a permanent electrically conductive connection, the connecting member being designed to be deformable so as to clamp and securely grip an earth cable.

2. An earth connector according to claim 1 wherein the tube has two ends, each end being adapted to receive a respective pipe part.

3. An earth connector according to claim 1, wherein the connecting member has a recess therein for receiving an end of the earth cable.

4. An earth connector according to claim 1, wherein the connecting member is a tube.

5. An earth connector according to claim 1, wherein the connecting member is arranged at an acute angle to the tube.

6. An earth connector according to claim 1, wherein the connecting member projects radially from the tube.

7. An earth connector according to claim 1, wherein the tube is pre-soldered so as to allow it to be soldered to the respective pipe parts.

8. An earth connector according to claim 7, wherein the tube has at least one recess on an interior surface of the tube, said at least one recess holding the solder for soldering the tube to the respective pipe parts.

9. An earth connector according to claim 8, wherein the or each recess is annular.

10. A method of earthing a metal pipe, comprising the steps of:

{I} providing an earth connector comprising a tube for connecting one end of a first pipe part to one end of a second pipe part, the pipe parts when connected being in fluid communication by way of the tube, the tube having a connecting member attached thereto by a permanent electrically conductive connection, the connecting member being designed to be deformable so as to clamp and securely grip an earth cable, {ii} attaching the tube to the respective ends of the pipe parts;

{iii} locating an exposed end of the earth cable adjacent to the connecting member, and {iv} deforming the connecting member so as to secure the earth cable thereto.

11. The method according to claim 10 wherein the step of attaching the tube to the respective ends of the pipe parts comprises the step of sealingly securing the ends of the pipe parts to the tube.

12. The method according to claim 10 wherein the connecting member has a recess for receiving the earth cable, wherein the step of locating an exposed end of the earth cable adjacent to the connecting member comprises inserting the exposed end into the recess, and wherein the step of deforming the connecting member so as to secure the earth cable thereto comprises clamping the connecting member so as to reduce the size of the recess and clamp the exposed end therein.

13. An earthing system comprising a first pipe part and a second pipe part, and an earth connector connecting said first pipe part and second pipe part together in fluid communication;

wherein the earth connector comprises a tube having a first end receiving the first pipe part and a second end receiving the second pipe part, the earth connector further having a connecting member attached thereto by a permanent electrically conductive connection; and an earth cable received in the connecting member and the connecting member being deformed so as to clamp and securely grip the earth cable.

14. An earthing system according to claim 13, wherein the tube has a recess on an interior surface of the first end of the tube and a recess on an interior surface of the second end of the tube, said recesses holding solder for soldering the first end to the first pipe part and the second end to the second pipe part.

15. An earthing system according to claim 13, wherein the connecting member is permanently connected to the tube at an acute angle.

* * * * *